United States Patent [19]

Wang

[11] Patent Number: 4,947,873

[45] Date of Patent: Aug. 14, 1990

[54] MICRO-COMPUTER CONTROLLED FULLY AUTOMATIC LIGHTING UNIT

[76] Inventor: Chin C. Wang, No. 54, Hsing Nong Rd., Hsin Sheng Li, Pei Doou Chen, Chang Hua Hsien, Taiwan

[21] Appl. No.: 386,949

[22] Filed: Jul. 31, 1989

[51] Int. Cl.[5] ..... F23Q 2/00; F23Q 7/00

[52] U.S. Cl. ..... 131/329; 131/182; 219/267; 219/268; 219/263

[58] Field of Search ..... 131/329, 178, 180, 182, 131/186, 187, 249, 250.1; 219/261, 267, 268, 270, 263

[56] References Cited

U.S. PATENT DOCUMENTS

| | | | |
|---|---|---|---|
| 2,643,930 | 6/1953 | Nissly | 219/261 X |
| 3,361,894 | 1/1968 | Lester | 219/267 X |
| 3,769,492 | 10/1973 | Senkewich | 219/261 X |
| 4,220,256 | 9/1980 | Torri | 219/267 X |
| 4,620,555 | 11/1986 | Schwarz | 131/329 X |

*Primary Examiner*—V. Millin, Jr.
*Assistant Examiner*—J. L. Doyle
*Attorney, Agent, or Firm*—Notaro & Michalos

[57] ABSTRACT

A microcomputer-controlled fully automatic lighting unit has a transmission line including a motor and necessary driving mechanism which, when being started, is able to deliver cigarettes to a place where they will be lighted by an induced electric heatable wire. The unit further has another transmission line including a motor and necessary driving mechanism which may send the lighted cigarette out of the unit and thereby safely and automatically completes a cycle of cigarette lighting procedure.

5 Claims, 3 Drawing Sheets

MICRO-COMPUTER CONTROLLED FULLY AUTOMATIC LIGHTING UNIT

FIELD OF THE INVENTION

The present invention relates to a cigarette lighting unit controlled by a micro-computer, especially by a electric circuit, that will automatically light and send out the cigarettes to provide the users with much convenience and safety.

BACKGROUND OF THE INVENTION

Presently, the most common way to light a cigarette is to use the flame from a lighter or a match to heat or burn the head of the cigarette. However, this will frequently cause careless accidents, either hurting someone's body or damaging something else. Disasters beyond imagination will happen more easily when a cigarette is lighted by a user in moving, such as a driver.

Even though some of the automobiles are provided with a cigarette lighting unit which lights a cigarette with heated wire, it still needs manual control and operation, and will inevitably distract the driver's attention and influence the driving safety, especially in a driving at high speed. Any small negligence will cause incredible results.

Therefore, it is the main object of the present invention to provide a kind of micro-computer controlled automatic cigarette lighting unit. With an electric circuit designed for this purpose, a cigarette may be delivered and lighted, then sent out automatically with only one pressing of a controlling switch by the user. As the user needs not be concerned with the whole process of lighting, the safety during driving or at any occasion will thereby be enhanced.

A specific embodiment of the present invention will now be described with reference to the accompanying drawings.

DETAILED DESCRIPTION OF THE INVENTION

Figure 1:
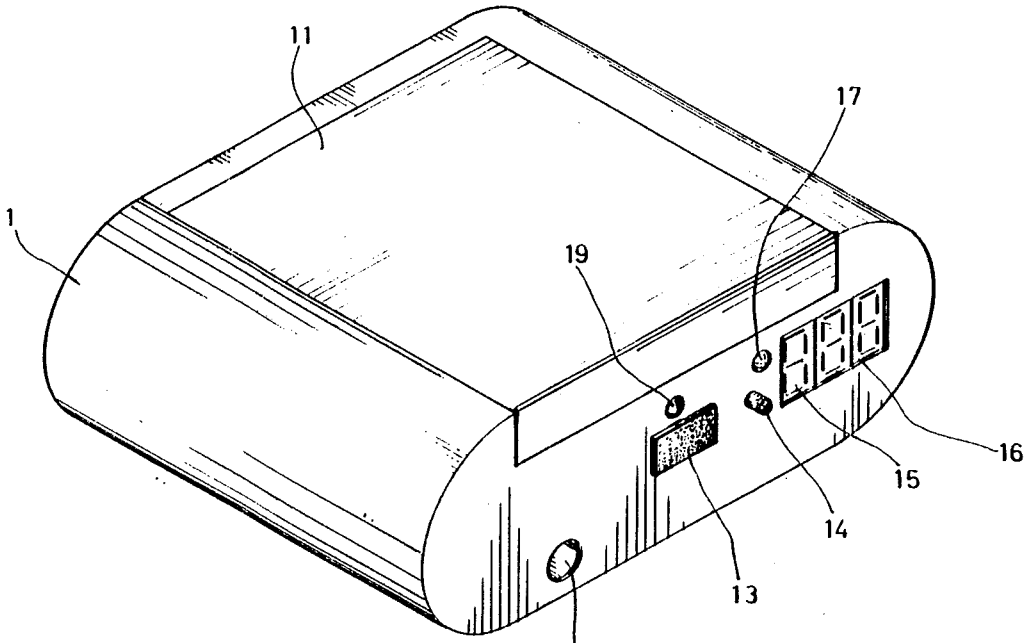
FIG. 1 is a three-dimensional perspective view showing the appearance of the present invention.
Figure 2:
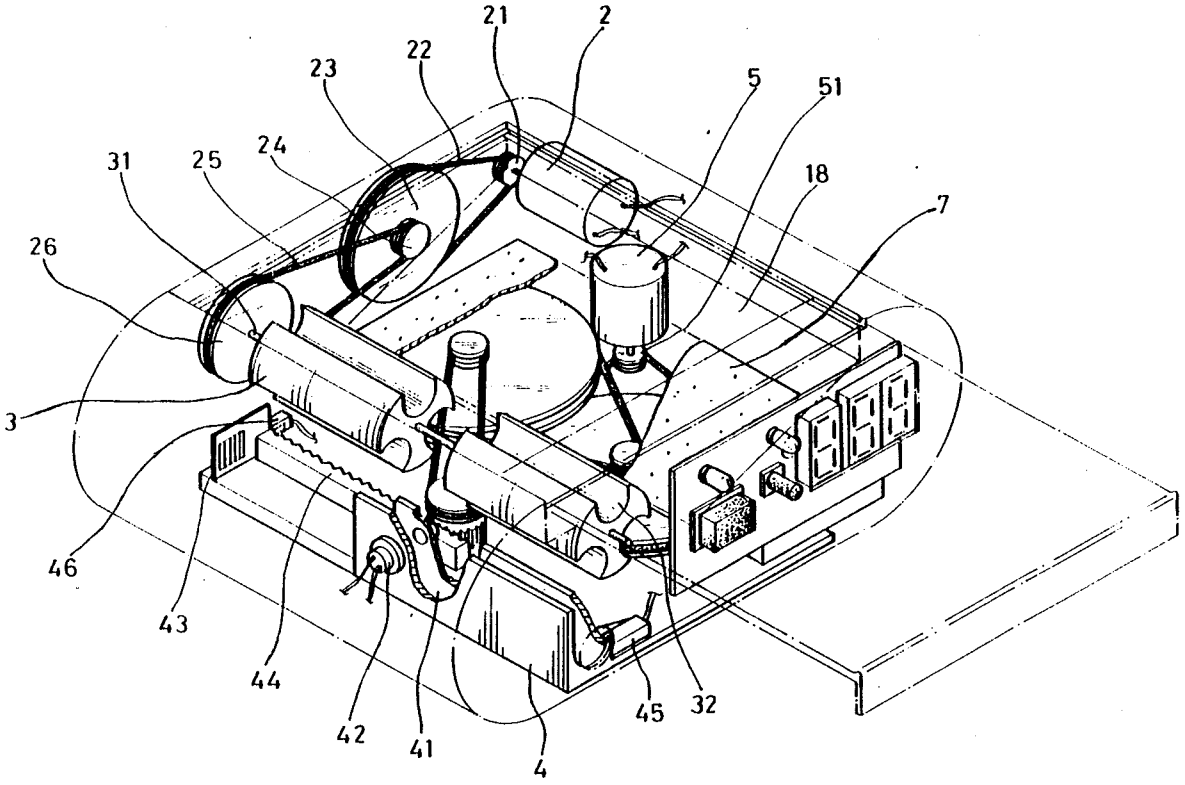
FIG. 2 is a three-dimensional perspective view showing the internal structure of the present invention.

Now referring to FIGS. 1 and 2, the present invention has a body 1 with a push and lift top cover 11. At the front edge of the top cover 11, a flange is formed to facilitate the application of force and, consequently, the opening of the top cover 11. On the front of the body 1, a pre-formed opening 12, a selector switch 13, a master switch 14, an indicator 15, a counter 16, a trouble indicator 17, and a power indicator 19 are separately provided. All the driving components are accommodated in the body 1 and are controlled by a circuit board 7 inside the body 1. An inclinedly set carrier 18 is positioned over all the driving components to divide the inner space of the body 1 into two parts. In the upper space, a total of 20 unpacked individual cigarettes 8 may be loaded on the carrier 18 as shown in FIG. 4.

Figure 3:
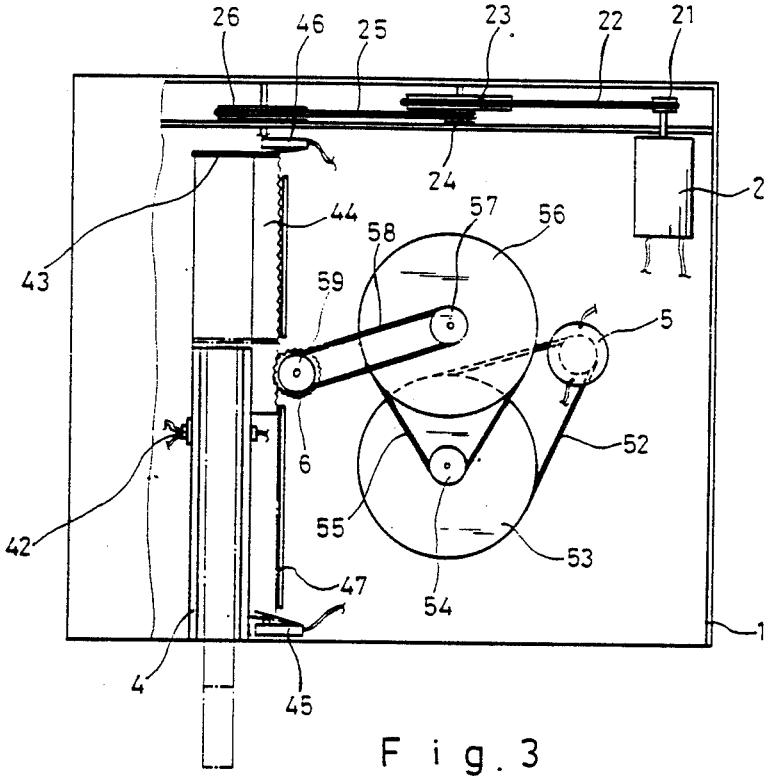
FIG. 3 is a simplified, top plan view of the present invention showing the driving system thereof inside the body.
Figure 4:
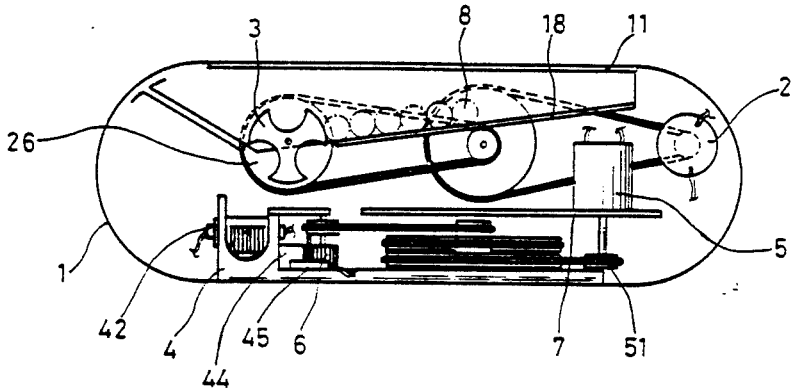
FIG. 4 is a simplified, sectional, front elevational view showing the internal structure of the present invention.

As shown in FIGS. 2 through 4, the driving mechanism and microcomputer-controlled circuit of the present invention comprises: a first motor 2 wherein a first turning wheel 21 is directly connected on its turning axle. A second turning wheel 23 is remotely connected with the first turning wheel 21 through the belt 22. A third turning wheel 24 which is smaller in diameter relative to turning wheel 23 and is co-axially located with the turning wheel 23 is further remotely connected to a fourth turning wheel 26 by belt 25. Two elongated impellers 3 are coupled with an axle 31 and are co-axial with the fourth turning wheel 26. A plurality of arched grooves 32 are formed on the outer surface of the impellers 3 and the impellers are just located at below the lower end of the carrier 18.

A cigarette container 4 is longitudinally provided in the body 1 at its lower side with an upside-opened round groove 41 formed inside thereof. The upside opening of the round groove 41 may generally be facing an arched groove 32 on the impellers 3 when the latter is turned. At the midway of the sidewalls of the round groove 41, a electric eye 12 is provided and a guiding plate 47 is set inside the body 1 at the side opposite to the electric eye 12 to form an elongated area wherein a rack 44 is installed. At the rear end of the rack 44, a backboard equipped with an electric heatable wire 43 is connected. And two contact switches 45 and 46 are respectively installed at the front and the rear end of said elongated area.

A fifth turning wheel 51 is directly connected on the turning axle of a second motor 5. A sixth turning wheel 53 is remotely connected to the fifth turning wheel 51 through the belt 52. A seventh turning wheel 54 which is smaller in diameter relative to turning wheel 53 and is co-axially located with the turning wheel 53 is further remotely connected to an eighth turning wheel 59 by belt 58. A gear 6 is co-axial with the turning wheel 59 and be engaged with the rack 44 exactly.

The main purpose of the above-mentioned turning wheels and belts is to provide adequate reduction of speed. The unpacked individual cigarettes 8 are placed on the space between the top cover 11 and the carrier 18. due to the inclination of the carrier 18, the cigarettes 8 will move toward the impellers 3 under the action of gravity. A total of 20 individual cigarettes may be accommodated in the above space.

Pressing the selector switch 13 will cause the first motor 2 to start and sequentially drive the belts 22 and 25, as well as the turning wheels 21, 23, 24, and 26, which further drives the impellers 3 to rotate steadily so that a cigarette 8 will fall into one of the arched grooves 32 on the impellers 3 and will be transferred by rotating impellers 3 to a place above the cigarette container 4 and then, automatically falls down into round groove 41 in the cigarette container 4. As soon as the cigarette 8 falls into the round groove 41, it will break the induction of the electric eye 42, and a signal will be sent to stop the operation of the motor 2. At the same time, the second motor 5 will be started and the electric heatable wire 43 will be heated, too. The running of the second motor 5, with the transmission and speed reduction caused by the belts 52, 55, and 58, as well as the turning wheels 51, 54, 56, 57, and 59 will drive the gear 6 to turn simultaneously which further drives the rack 44 to move forward. While the electric-heatable wire 43 moves forward and touches the head of the cigarette 8 in the round groove 41, it will light the cigarette 8 and push the same outwardly toward the opening 12.

As the front end of the rack 44 touches the first contact switch 45, the cigarette 8 will be lighted on the front end thereof and the other end thereof will be exposed to the outer environment through the opening 12. At this point, the induction of the contact switch 45 will stop the second motor 5 immediately, and causes a buzzer provided in the circuit board 7 to sound informing the operator to take out the cigarette.

As soon as the cigarette 8 is removed from the round groove 41, the induction of the electric eye 42 will recover and causes the second motor 5 to run in reverse direction which drives the rack 44 to move backward and breaks the heating of electric-heatable wire 43. When the rear end of the rack 44 touches the second contact switch 46, the second motor 5 stops running in reverse direction. Therefore, the cigarette automatic lighting procedure provided by the present invention is completed.

If a continuous lighting is desired, the operator needs only to press the selector 13 as many times as the number of cigarettes to be lighted. The times being pressed may be indicated by the indicator 15 and a maximum of 9 times may be shown. Whenever any cigarette 8 stuck in the impellers 3, the trouble indicator 17 will turn on. In addition, the counter 16 may indicate the number of cigarettes 8 having been lighted so that the user may know the number of remaining cigarettes in body 1 and fill in additional ones in time, if necessary. The master switch 14 controls the activation of the entire mechanism, and the power indicator 19 will show the status of power supply.

In brief, the present invention is an exquisite design and it provides a set of fully computer-controlled automatically lighting unit. Users may use it at any place, particularly in an automobile, with full convenience and enhanced safety.

We claim:

1. A microcomputer-controlled fully automatic lighting unit comprising a body having a top cover which has a flange at its front edge to facilitate the push and lifting of the top cover, and a front panel thereon on which a master switch, selector, counter, indicator, power indicator, and trouble indicator are provided and electrically connected to a circuit board constructed inside said body;

a carrier plate inclinedly constructed inside said body in manner that the inner space of said body will be divided and separated into an upper part and a lower part; said upper part being able to accommodate a plurality of unpacked individual cigarettes;

a first transmission line including a motor, a first turning wheel directly connected to said motor at the end of a turning axle of said motor, a second turning wheel being remotely connected to said first turning wheel with a first belt, a third turning wheel being co-axial with and smaller in diameter than said second turning wheel, and a fourth turning wheel being remotely connected to said third turning wheel with a second belt;

two impellers being co-axially coupled in a manner that one end of the axle which couples said impellers will connect to said fourth turning wheel of said first transmission line; said impellers having a plurality of arched grooves formed on their outer surfaces and being located substantially at a position close to the lower end of said inclined carrier plate in a manner that cigarettes on said carrier plate will fall down into the arched grooves naturally;

a cigarette containing portion generally located under said impellers, having a longitudinal axis parallel to the axis which couples said impellers and having an upward opened round groove longitudinally with a bottom and sidewalls formed in said containing portion, an electric eye installed at the midway of the sidewalls of said round groove, a guide plate provided outside one of said sidewalls to form an elongated passage between it and said sidewall permitting a rack to move forward and backward therein, an electric-heatable wire contained in a backboard attached to said rack at its rear end toward said first transmission line, and two contact switches provided one at each end of said elongated passage; and a second transmission line including a motor, a first turning wheel directly connected to said motor at the end of a turning axle of said motor, a second turning wheel being remotely connected to said first turning wheel with a first belt, a third turning wheel being co-axial with and smaller in diameter than said second turning wheel, a fourth turning wheel being remotely connected to said third turning wheel with a second belt, and a gear driven by said fourth turning wheel and being able to engage with said rack.

2. A microcomputer-controlled fully automatic lighting unit as claimed in claim 1, wherein said first transmission line, when said motor included therein is started, will drive said impellers to rotate and cause the cigarettes falling into said arched grooves to move with said impellers and then fall into said round groove to break the induction of said electric eye, which causes said first set of transmission line to stop running and starts said second transmission line which causes said gear to drive said rack to move forward toward the front of said body while a said electric-heatable wire will heat the cigarette in said round groove.

3. A microcomputer-controlled fully automatic lighting unit as claimed in claim 2, wherein said second transmission line will be stopped when said touches said first contact switch and pushes outwardly the lighted cigarette.

4. A microcomputer-controlled fully automatic lighting unit as claimed in claim 3, wherein said second transmission line will be started again and will run in reverse direction to drive said rack to move backward as soon as the lighted cigarette is removed out of said round groove, while, meanwhile, said electric-heatable wire will stop its heating; and said second transmission line will stop its reverse running when said backwardly moving rack touches said second contact switch.

5. A microcomputer-controlled fully automatic lighting unit as claimed in claim 3 or 4, wherein said indicator indicates the times of lighting and said counter indicates the cigarette being lighted; and a buzzer is installed which sounds when the lighted cigarette is pushed outwardly.

* * * * *